US010321733B2

(12) United States Patent
Mulholland

(10) Patent No.: US 10,321,733 B2
(45) **Date of Patent: *Jun. 18, 2019**

(54) CONVERTIBLE SHOE

(71) Applicant: Sarah Melissa Mulholland, Lexington, KY (US)

(72) Inventor: Sarah Melissa Mulholland, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/959,420

(22) Filed: Apr. 23, 2018

(65) Prior Publication Data

US 2018/0235309 A1 Aug. 23, 2018

Related U.S. Application Data

(63) Continuation of application No. 13/943,865, filed on Jul. 17, 2013, now Pat. No. 9,974,353.

(51) Int. Cl.

| | |
|---|---|
| ***A43B 3/00*** | (2006.01) |
| ***A43B 3/24*** | (2006.01) |
| ***A43B 21/00*** | (2006.01) |
| ***A43B 1/00*** | (2006.01) |
| ***A43B 5/00*** | (2006.01) |
| ***A43B 13/26*** | (2006.01) |
| ***A43B 23/25*** | (2006.01) |

(52) U.S. Cl.

CPC ..... *A43B 3/246* (2013.01); *A43B 1/0081* (2013.01); *A43B 3/0078* (2013.01); *A43B 3/24* (2013.01); *A43B 3/244* (2013.01); *A43B 5/001* (2013.01); *A43B 13/26* (2013.01); *A43B 21/00* (2013.01); *A43B 23/25* (2013.01)

(58) Field of Classification Search

CPC ..... A43B 3/246; A43B 3/244; A43B 13/141
USPC ..... 36/101, 100
See application file for complete search history.

(56) References Cited

U.S. PATENT DOCUMENTS

| | | | | | |
|---|---|---|---|---|---|
| 2,405,498 | A | * | 8/1946 | Gregg | A43B 13/37 36/28 |
| 2,509,423 | A | * | 5/1950 | Cramer | A43B 7/38 36/105 |
| 2,540,449 | A | * | 2/1951 | Kaufmann | A43B 21/00 36/105 |
| 2,552,943 | A | * | 5/1951 | Edgaras | A43B 3/24 36/101 |
| 2,719,367 | A | * | 10/1955 | Bergmans | A43B 13/28 36/12 |
| 2,761,224 | A | * | 9/1956 | Gardiner | A43B 3/122 36/101 |

(Continued)

*Primary Examiner* — Sally Haden
*Assistant Examiner* — Jillian K Pierorazio
(74) *Attorney, Agent, or Firm* — Michael Coblenz

(57) ABSTRACT

The convertible shoe consists of: a top portion having a stylized upper, a footbed, and an underside with bottom side attachment; an insert with top side attachment and a bottom side attachment; and a bottom portion having a top side attachment and a tread on the bottom. The top side attachment of the bottom portion and insert are identical, and the bottom side attachment of the top portion and insert are identical. The bottom side attachment is sized and configured to correspond to, and attach to, the top side attachment, such that the top portion can attach directly to the bottom portion to create a low-heeled shoe, or attach to the insert which is attached to the bottom portion to create a high-heeled shoe.

12 Claims, 17 Drawing Sheets

(56) References Cited

U.S. PATENT DOCUMENTS 3,016,630 A * 1/1962 Twiggs, Jr. ..... A43B 3/122 36/101
3,133,360 A * 5/1964 Taylor, Jr. ..... A43B 15/00 12/142 F
3,538,628 A * 11/1970 Einstein, Jr. ..... A43B 3/0078 36/1
3,902,259 A * 9/1975 Cracco ..... A43B 3/103 36/101
4,084,333 A * 4/1978 Del Vecchio ..... A43B 3/108 36/43
4,103,440 A * 8/1978 Lawrence ..... A43B 3/24 36/101
4,176,459 A * 12/1979 Perser ..... A43D 1/02 33/3 R
4,267,650 A * 5/1981 Bauer ..... A43B 13/36 36/101
4,317,294 A * 3/1982 Goodyear ..... A43B 13/36 36/100
4,369,537 A * 1/1983 Midgley ..... A43B 15/00 12/142 RS
4,420,894 A * 12/1983 Glassman ..... A43B 13/28 36/107
4,586,209 A * 5/1986 Bensley ..... A43D 25/06 12/142 D
4,887,369 A * 12/1989 Bailey ..... A43B 3/24 36/101
4,974,344 A * 12/1990 Ching ..... A43B 3/24 36/100
5,519,950 A * 5/1996 Wang ..... A43B 21/39 36/36 R
5,822,888 A * 10/1998 Terry ..... A43B 3/24 36/100
6,389,712 B1 * 5/2002 Schelling ..... A43B 13/122 36/103
6,519,876 B1 * 2/2003 Geer ..... A43B 1/0081 36/102
6,948,263 B2 * 9/2005 Covatch ..... A43B 7/1425 36/30 R
7,018,496 B1 * 3/2006 George ..... A44B 18/008 156/152
7,111,416 B2 * 9/2006 Gallegos ..... A43B 3/24 36/100
7,191,551 B2 * 3/2007 O'Connor ..... A43B 3/108 206/278
7,246,453 B2 * 7/2007 Kim ..... A43B 5/00 36/100
7,249,428 B1 * 7/2007 Burella ..... A43B 3/0078 36/134
7,600,332 B2 * 10/2009 Lafortune ..... A43B 7/142 36/30 R
7,695,057 B2 * 4/2010 Autterson ..... A44B 18/0053 24/306
7,752,695 B2 * 7/2010 Kaufman ..... A43B 3/108 12/142 J
7,765,722 B2 * 8/2010 Berrins ..... A43B 3/24 36/100
8,307,571 B1 * 11/2012 Ceylan ..... A43B 3/246 36/101
9,210,967 B2 * 12/2015 Gerber ..... A43B 5/02
9,408,434 B2 * 8/2016 Su ..... A43B 5/08
9,737,109 B2 * 8/2017 Johnson ..... A43B 13/12
2001/0042319 A1 * 11/2001 Coomes ..... A43B 3/0078 36/11.5
2002/0174569 A1 * 11/2002 Tsai ..... A43B 3/103 36/101
2003/0136028 A1 * 7/2003 Magallanes ..... A43B 21/42 36/100
2003/0200675 A1 * 10/2003 Gross ..... A43B 1/0081 36/15
2003/0200676 A1 * 10/2003 Gross ..... A43B 1/0081 36/15
2004/0221486 A1 * 11/2004 Dennison ..... A43B 7/18 36/31
2006/0107553 A1 * 5/2006 Clark ..... A43B 3/26 36/97
2010/0050474 A1 * 3/2010 Shittu ..... A43B 1/0081 36/101
2011/0232127 A1 * 9/2011 Chaney ..... A43B 5/08 36/15
2013/0219751 A1 * 8/2013 Catlett ..... A43B 3/122 36/101
2015/0128450 A1 * 5/2015 Fronhoffs ..... A43B 1/02 36/87
2017/0231316 A1 * 8/2017 Sethi ..... A43B 13/36 36/97
2018/0055138 A1 * 3/2018 Osborn ..... A43B 3/244

* cited by examiner

CONVERTIBLE SHOE

CROSS REFERENCE TO RELATED APPLICATIONS

This application is a continuation of U.S. application Ser. No. 13/943,865, filed on Jul. 17, 2013, and allowed on Mar. 5, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to footwear with removable and replaceable inserts and soles to convert a low heel shoe to a higher heel shoe, or convert a casual shoe to a sport shoe.

Description of the Related Art

There are a number of existing inventions related to shoes having added inserts to alter the shoe from a low heeled shoe or flat to a higher heeled shoe, and there are a number of existing inventions relating to shoes with removable and replaceable soles. U.S. Pat. No. 7,752,695, issued Jul. 13, 2010 to Kaufman et al., is drawn to a shoe having an insertable and removable wedge that can be inserted into an openable space in the heel of the shoe between the insole and the sole. The invention is drawn to a temporary insert for use during the finishing process, but it teaches the use of a removable insert to alter the height of the heel of the shoe.

U.S. Patent Application Publication No. US2003/0200675 to Gross, published on Oct. 30, 2003, teaches a sandal or "flip-flop" style shoe with multiple inserts, or core modules, to adjust the height of the shoe. The core modules are all essentially flat and of uniform thickness so the overall height of the shoe is altered but not the height of the heel in relation to the toe. The core modules are positioned by a series of corresponding holes and insertable pins, and held together by mating hook and loop material.

U.S. Pat. No. 3,902,259, issued Sep. 2, 1975 to Cracco, discloses a sandal with interchangeable side plates and sole. The side plates and sole can be removed and replaced through a series of interlocking slots and are positioned with corresponding projections and holes. The side plates and sole can be altered to alter the look of the sandal, and in one embodiment a flat sole can be replaced with a sole with a wedge heel to convert the shoe from a low heel to a higher heel. Cracco does not disclose the use of an intermediate insertable component to alter a low heel into a high heel, and involves multiple components with a complicated locking mechanism.

U.S. Pat. No. 5,317,822 issued Jun. 7, 1994 to Johnson, is drawn to an athletic shoe with interchangeable wear sole, or sole tread. The purpose is to allow the user to alter the tread to best match the tread to the surface of the athletic play area. The sole is positioned by a series of knobs and knob chambers that correspond to align the components, and the sole is held in place by VELCRO® hook and loop material and a series of lock brackets with locking pins placed around the perimeter of the sole. U.S. Pat. No. 7,549,237 issued on Jun. 23, 2009 to Gallegos, discloses a shoe with a removable and interchangeable cushion and orthotic plate. The cushion and orthotic plate are positioned and held in place by corresponding studs and apertures, or in the alternative by hook and loop material such as VELCRO®. Gallegos does not alter the height of the heel or the tread on the sole.

U.S. Patent Application Publication No. US2009/0193684 to Diamond, published on Aug. 6, 2009, teaches a convertible shoe with removable and replaceable foot bed upper and sole portion with various height and style sole and heel portion. The components are aligned by a series of corresponding prongs and recesses, and held in place by corresponding hook and loop material such as VELCRO®, along with a series of snap like fasteners on the periphery of the outsole. Diamond discloses heels of differing heights and styles, but does use an insert placed between the insole and sole to alter the height of the shoe or the heel.

SUMMARY OF THE INVENTION

Shoes with high heels are fashionable, but often uncomfortable. High heels are particularly uncomfortable if worn for long periods of time. Because of this, it is very common for a woman to carry an extra pair of shoes to change into when she is wearing high heels for an extended period of time. Women will frequently wear a pair of flats, or often tennis shoes, to work in the morning, and then switch into dressier shoes with high heels at the office. Often, if wearing high heels in the evening, a woman will also carry a pair of more comfortable shoes, such as ballet flats or flip-flops, in her purse for later wear. It is also not uncommon to see women in bare feet after wearing high heels for an extended length of time. There is a need, therefore, for a shoe that is both fashionable and easily convertible from a high to a low heel, and for a shoe that is easily convertible to a sport shoe.

The invention is a convertible shoe that consists of an insole with a foot bed and upper, and insert, and a sole. There is a standard attachment that connects the insole to the insert and the insert to the sole. The insole can be attached directly to the sole to create a flat or a shoe with a low heel, and the insert can be added between the insole and the sole to create a shoe with a higher heel. In one variation there can be two or more inserts to create a shoe with multiple and variable heights. In another variation there can be different tread configurations on the bottom of the sole to create different types of shoes with the same upper, for example a dress shoe and a golf shoe, by means of an interchangeable sole bottom.

The preferred embodiment of the convertible shoe will be a wedge style shoe. The wedge will have three separate components: an upper components consisting of an insoles; a middle component consisting of an insert; and a bottom component consisting of a sole. This wedge will go from a high heel, with an approximate height of four inches when all three components are fastened together, to a lower heel of approximately one to two inches when the middle insert is removed, and the insole is attached directly to the sole. The upper insole will always be the top of the shoe and the bottom sole will always be the bottom of the shoe. This version of the shoe will be available for women with a variety of style uppers.

The convertible shoe of the present invention will also have a sport shoe version, that has only the upper insole and the bottom sole. This version will feature convertible bottom soles with different treads, and will convert from a tennis shoe or dress shoe to a golf shoe by replacing the bottom sole. There would be at least two different versions of this sport shoes: One will be a men's wingtip or dress shoe that can convert to a golf shoe, and the other version would be a women's or men's tennis shoe that would convert to a golf shoe, by changing the sole and tread. This version of the shoe will be available in men, women, and children's versions and styles.

One of the technical difficulties of creating a removable attachment for components of a shoe is that it has to be strong enough to withstand the dynamic forces on the shoe and keep the components securely attached, while at the same time also be easily and conveniently detachable. The present invention accomplishes this by means of the attachment mechanism which consists of the paired protruding perimeter ridge and recessed perimeter channel and the attachment material. The perimeter ridge is on the underside of the upper component and the recessed channel is on the top side of the lower component. There is attachment material on both components. The attachment material holds the two components together, while the paired perimeter ridge and perimeter channel allow the attachment to withstand the forces on the shoe and keep the components securely attached. The paired perimeter ridge and channel also protect the attachment material from dirt and other foreign material when the components are attached, which will prevent the fouling of the attachment material and reduction of the attachment properties of the attachment material. The combination of the paired ridge and channel and the attachment material has proven so secure that in some cases is has been difficult to separate the components. This led to the creation of the additional element of the concave cross section on the sole and insert, and the flared cross section on the insole, which create both an attractive look on the back of the shoe, and a convenient hand grip to hold the components for attachment and disassembly.

DETAILED DESCRIPTION OF THE INVENTION

Figure 1:
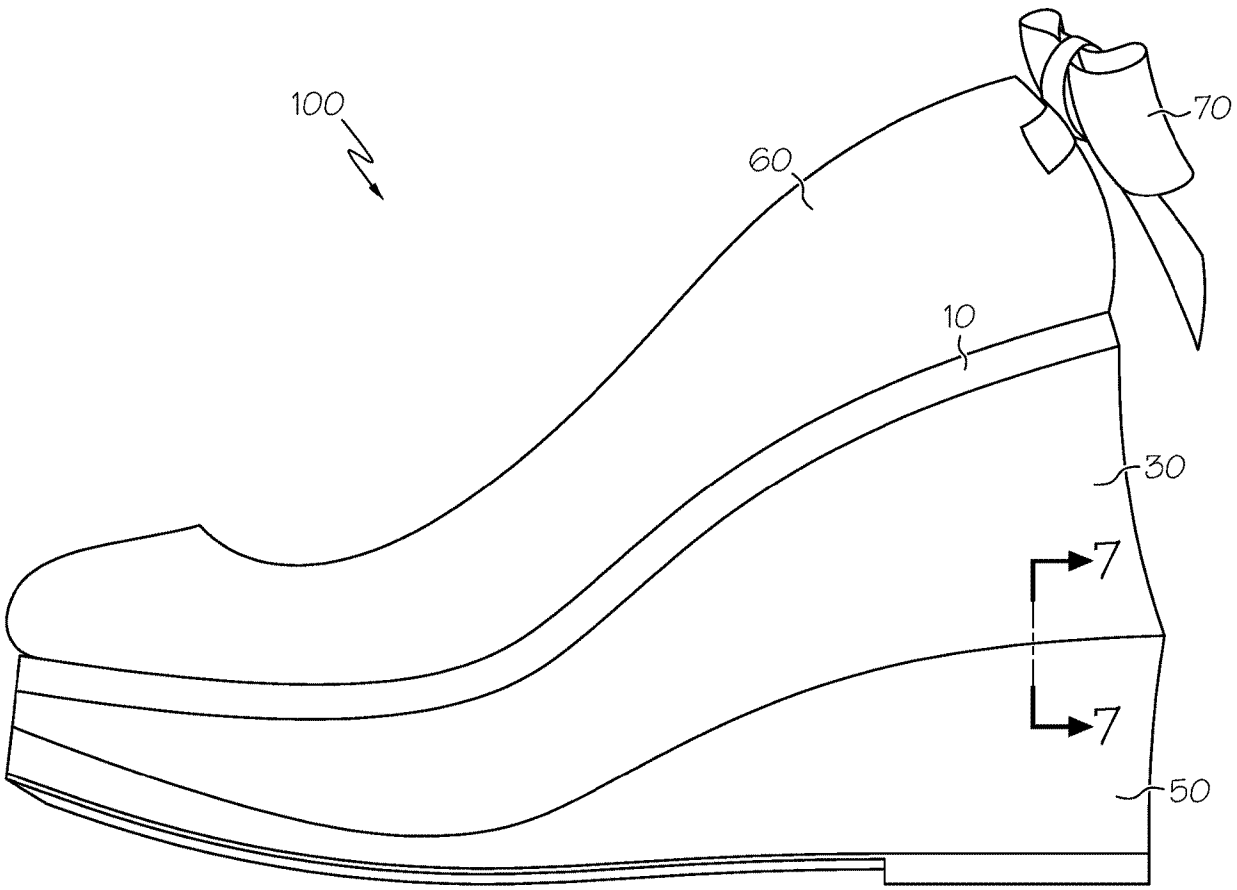
FIG. 1 is a side view of the convertible shoe with the insole attached to the insert and the insert attached to the sole.

Detailed embodiments of the present invention are disclosed herein. It is to be understood, however, that the disclosed embodiments are merely exemplary of the invention and that the invention may be embodied in various and alternative forms. Therefore, specified structural and functional details disclosed herein are not to be interpreted as limitations, but merely as a basis for the claims and as a representative basis for teaching one skilled in the art to variously employ the present invention.

The convertible shoe 100 will go from a low heel to a high heel by simply adding an insert 30 between the top insole 10 and the bottom sole 50. In the preferred embodiment, the convertible shoe 100 will consist of three different components; a top portion consisting of an insole 10 with a foot bed 11 and a styled upper 60; a middle portion consisting of an insert 30; and the bottom portion consisting of the sole 50. The components are attached by a uniform attachment means, described in detail below, that allows the insole 10 to attach directly to the sole 50 for a low heel, or include the insert 30 for a shoe with a higher heel. In an alternate version there can be multiple inserts each with uniform thickness, of approximately one inch thickness at the rear in the preferred embodiment, which allows the creation of a shoe with a heel from 1 inch to 4 inch thickness in one inch increments. In a second embodiment the insole 10 can attach directly to the sole 50, but there will be a number of interchangeable soles 50 with differing tread components 52 on the bottom, so that by changing the sole 50 the type of shoe can be changed. This will allow, for example, the ability to change from a dress shoe to a golf shoe. Details of these embodiments will be described in conjunction with the attached figures.

Figure 2:
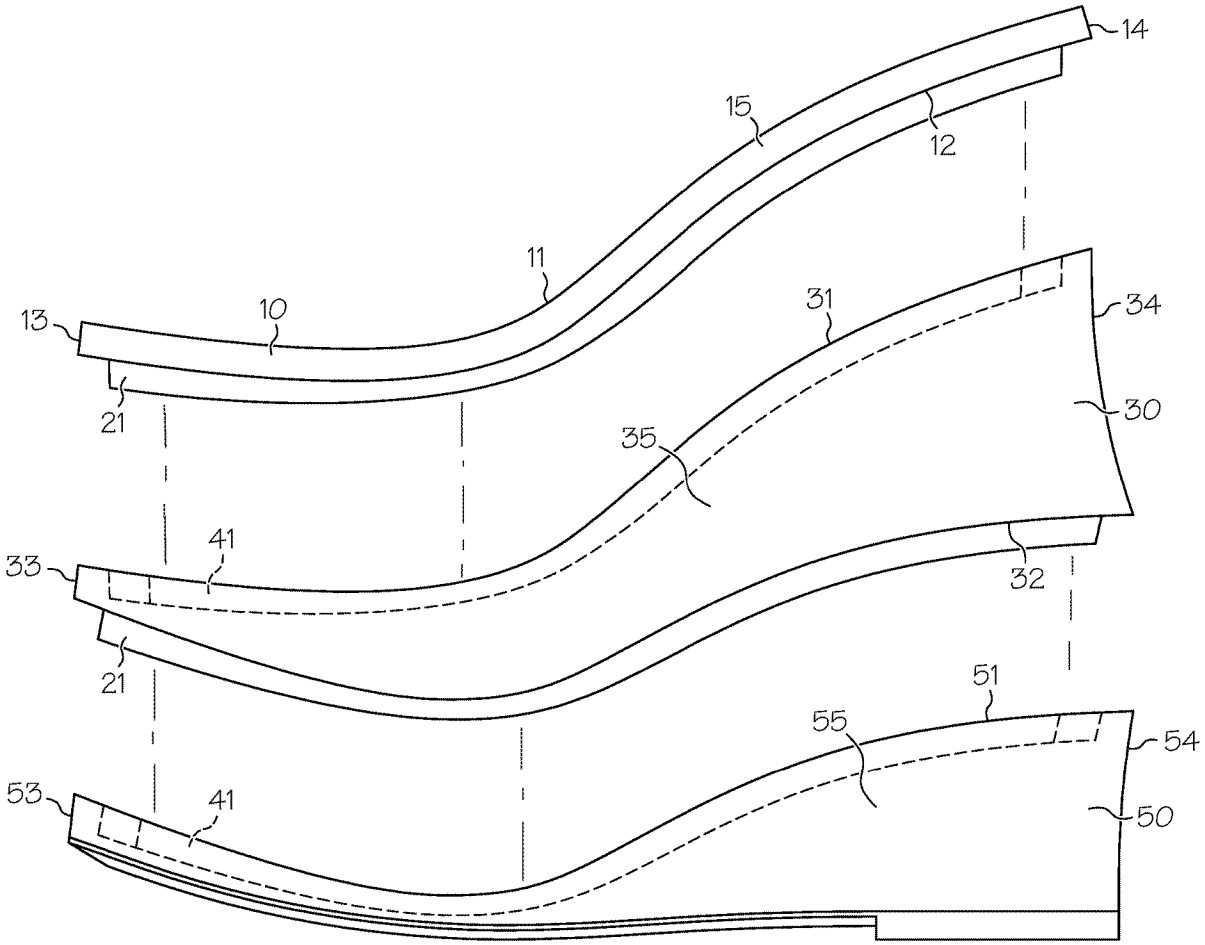
FIG. 2 is an exploded side view of the convertible shoe showing the insole in position to be attached to the insert and the insert in position to be attached to the sole.

As seen in FIG. 1 & FIG. 2 the convertible shoe 100 consists of an insole 10, an insert 30, and a sole 50. The insole 10 has a footbed 11, which is on the top of the insole 10 and where the wearer's foot will rest. There is an insole toe end 13 and an insole heel end 14, which correspond to the wearer's heel and toe, and to standard footwear terminology. And there is an insole perimeter 15 which runs around the perimeter of the insole 10, and corresponds to what is commonly called the outsole. The insole 10 also has a bottom surface 12 which includes the bottom surface 20 attachment components, which will be described below. The insert 30 has a top surface 31, a bottom surface 32, an insert toe end 33, an insert heel end 34, and an insert perimeter 35, which is the outside surface of the insert 30. The insert bottom surface 32 includes the bottom surface 20 attachment components, described below. The insert top surface 31 includes the top surface 40 attachment components described below. The sole 50 has a top surface 51, an underside, often called and referred to herein the tread 52, a sole toe end 53, a sole heel end 54, and a sole perimeter 55 or outer surface or outsole. The sole top surface 51 includes the top surface 40 attachment components as described below. The convertible shoe 100 is designed so that the insole bottom surface 12 and the insert bottom surface 32 are uniform and identical, and the insert top surface 31 and sole top surface 51 are uniform and identical, with both bottom surfaces having the same uniform bottom surface 20 attachment components, and both top surfaces having the same uniform top surface 40 attachment components. And, as described below, the bottom surface 20 attachment components correspond to and mate with the top surface 40 attachment components so that the insole 10 can be attached directly to the sole 50 to create a low heeled shoe, or attached to the insert 30 and the insert 30 attached to the sole 50 to create a high heel shoe.

The insole 10, as best seen in FIG. 2 has an essentially uniform thickness between the footbed 11 and the bottom surface 12 running from the insole toe 13 to the insole heel 14. The insole 10 of all variations of the shoe 100 has a uniform thickness. In the preferred embodiment the insole 10 is 7.0 mm thick, but can run between approximately one quarter inch thick to three quarters of an inch thick. The insert 30 has a wedge shaped between the top surface 31 and the bottom surface 32, which is thin at the insert toe 33 and thick at the insert heel 34 to create a wedge shape that is thicker at the heal 34 than the toe 33. The insert 30 of all variations of the shoe 100 has a wedge shaped thickness. The insert 30 of the preferred embodiment has a thickness at the insert toe 33 of approximately 7 mm thick, and has a thickness at the insert heel 54 of approximately 45 mm thick. The thickness as the insert toe end 33 will always be roughly one quarter of an inch thick, but the thickness at the insert heel end 34 can range between approximately one inch and approximately three inches. The sole 50, depicted in the side view of FIG. 2, has a wedge shape between the top surface 51 and the tread 52, which is thin at the sole toe 53 and thicker at the sole heel 54 and is curved from the toe end 53 to the heel end 54. As seen in FIG. 2, the curve of the top surface follows the increased and changing thickness of the shoe component. The curve begins slightly downward from the toe end 53 to the middle then curves upwardly in the middle under the typical arch of the foot and finally curved back down and roughly flat towards the heel end 54. Since the bottom surface 20 of the insert 30 attaches to the top surface 40 of the sole 50, as described in detail below, the bottom surface 20 has the same curve as the top surface 40 of the insert, and since the bottom surface 20 of the insole 10 can attach to the top surface 40 of the sole 50, the bottom surface 20 of the insole 10 has the same curve as the top surface of the sole 50, and since the top surface 40 of the insert 30 can attach to the bottom surface 20 of the insole 10 the top surface of the insert has the same curve as the bottom surface 20 of the insole 10. This can be seen by reference to FIG. 1, which shows the components in the attached configuration, and FIG. 2, which shows the components separated. In the preferred embodiment the thickness of the sole 50 is approximately 7 mm at the sole toe 53 and approximately 58 mm at the sole heel 54. The thickness of the sole 50 at the sole toe 53 will always be approximately one half of an inch, but the thickness at the sole heel end 54 can range from between one half inch, for the convertible sports version as described below, to approximately three inches for the high heel version. FIGS. 1 & 2 also show that the toe end of the shoe (13, 33 and 53) also is curved up slightly. This is common among shoes, particularly high-heel shoes, and is referred to as the "kick up." The kick up allows the wearer to roll forward on the ball of the foot, and is necessary to allow the wearer of the shoe 100 to walk comfortably and normally.

Figure 4:
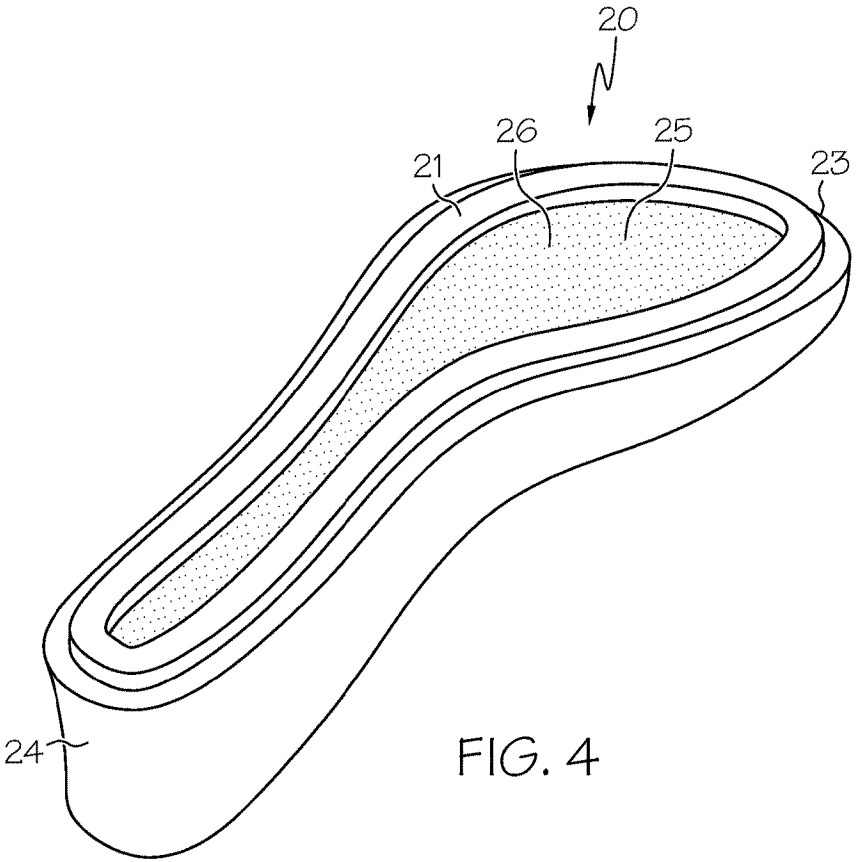
FIG. 4 is a bottom perspective view of the first embodiment of the bottom attachment, showing the protruding ridge and the bottom attachment field.

The first embodiment of the attachment means are show in FIGS. 3, 4, 5, & 6. The bottom surface attachment 20 is shown in FIG. 4. The uniform bottom surface and uniform bottom surface attachment components 20 is are shown in FIG. 4. The uniform bottom surface attachment components 20 are disposed on the uniform bottom surface. The bottom surface attachment 20 is the same on the insole 10 bottom surface 12 and the insert 30 bottom surface 32. The bottom surface attachment 20 has a toe end 23 and a heel end 24, and consists of a protruding perimeter ridge 21, and a bottom attachment field 25 which is located within the perimeter ridge 21. The perimeter ridge 21 has an essentially rectangular cross section and is approximately ¼ (one quarter) of an inch wide and approximately ¼ (one quarter) of an inch thick, but this size can vary slightly. In the preferred embodiment the perimeter ridge 21 is 8.0 mm at the top and tapers slightly to 8.3 mm at the bottom, where the perimeter ridge 21 attaches to the surface 20. The height of the perimeter ridge 21 is 6.0 mm. The perimeter ridge 21 is offset a uniform distance from the outer perimeter surface 15 and 35 of the insole 10 and insert 30 which means that the outer perimeter surfaces 15 and 35 of the insole 10 and insert 30 are aligned and therefore uniform. In most embodiments the perimeter ridge 21 is offset approximately 6.0 to 8.0 mm, although the uniform offset can vary depending upon the size of the shoe. There is a sheet of attachment material 26 located in the bottom attachment field 25. In one variation the attachment material 26 is standard hook and loop material common known as VELCRO®, and in another embodiment the attachment material 26 is "Mushroom VELCRO®" such as that sold under the brand name 3-M™ Dual Lock™ fastener. This material is known as mushroom VELCRO® because its cross section resembles a mushroom with a head protruding from a stem. When two corresponding sheets of mushroom VELCRO® are pressed together the heads snap into the space created by the stems to produce a very secure fit. The attachment material 26 is adhered to the attachment field 25 by gluing or other conventional and well known means.

Figure 3:
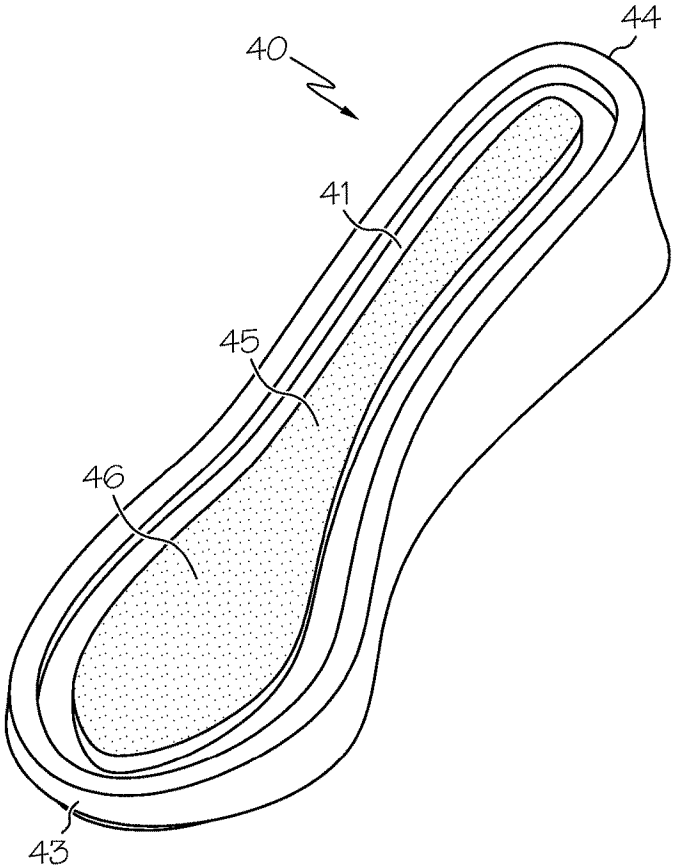
FIG. 3 is a top perspective view of the first embodiment of the top attachment showing the channel and the top attachment field.
Figure 5:
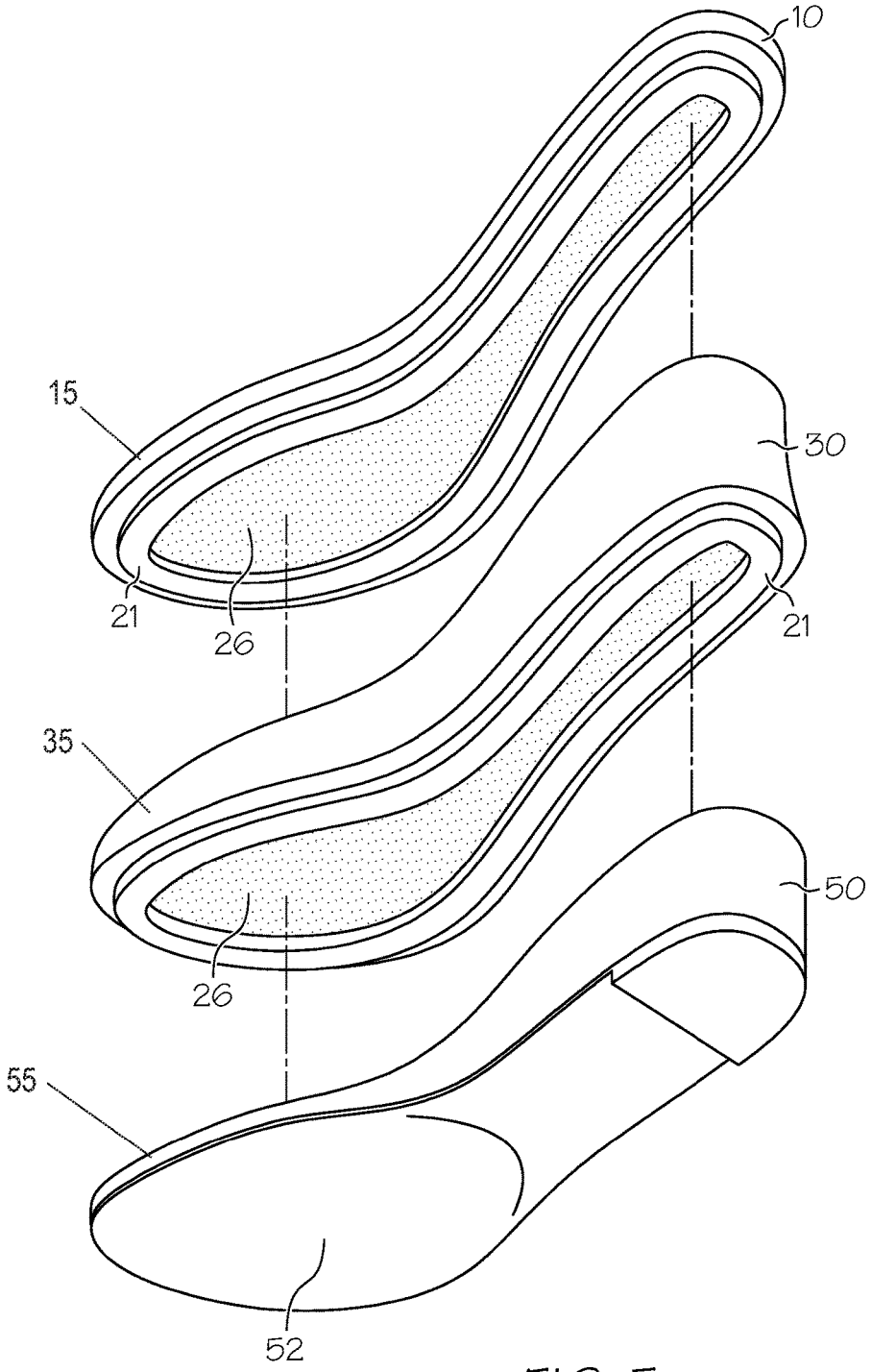
FIG. 5 is an exploded perspective from the underside of the convertible shoe showing the first embodiment of the bottom attachment of the insole and insert, and the tread of the sole.

The uniform top surface and uniform top surface attachment components 40 is are shown in FIG. 3, and is the same in the top surface of the insert 30 and the sole 50. The uniform top surface attachment components 40 are disposed on the uniform top surface. The top surface attachment 40 has a toe end 43 and a heel end 44, and consists of a perimeter channel 41, and a top attachment field 45 which is located on the top surface within the perimeter channel 41. The perimeter channel 41 of the top surface 40 corresponds to the perimeter ridge 21 of the bottom surface 20 so that the perimeter ridge 21 protrudes downward and fits into and mates with the perimeter channel 41. The perimeter channel 41 has a roughly rectangular cross section and is approximately ¼ (one quarter) of an inch wide and approximately ¼ (one quarter) of an inch thick. In the most preferred embodiment the channel 41 is 8.2 mm wide at the bottom and 8.5 mm wide at the top, and is 6.0 mm deep. The perimeter channel 41 is offset a uniform distance from the outer perimeter surface 35 and 55 of the insert 30 and bottom sole 50 which means that the outer perimeter surfaces 35 and 55 of the insert 30 and bottom sole 50 are aligned and therefore uniform. In most embodiments the perimeter channel 41 is offset approximately 6.0 to 8.0 mm, although the uniform offset can vary depending upon the size of the shoe. In the preferred embodiment the paired perimeter ridge 21 and perimeter channel 21 run the entire perimeter of the shoe component. In alternate embodiments the paired perimeter ridge 21 and perimeter channel 41 does not run the entire perimeter, but run substantially the entire perimeter, with occasional gaps in the channel 41 and ridge 21. There is a sheet of attachment material 46 attached to the top attachment field 45, by gluing or other well known attachment means. In one variation the attachment material 46 is standard hook and loop material common known as VELCRO®, and in another embodiment the attachment material 46 is Mushroom VELCRO®. Obviously the top attachment material 46 will correspond to the bottom attachment material 26, so both will either be standard hook and loop material or both will be mushroom VELCRO®.

Figure 7:
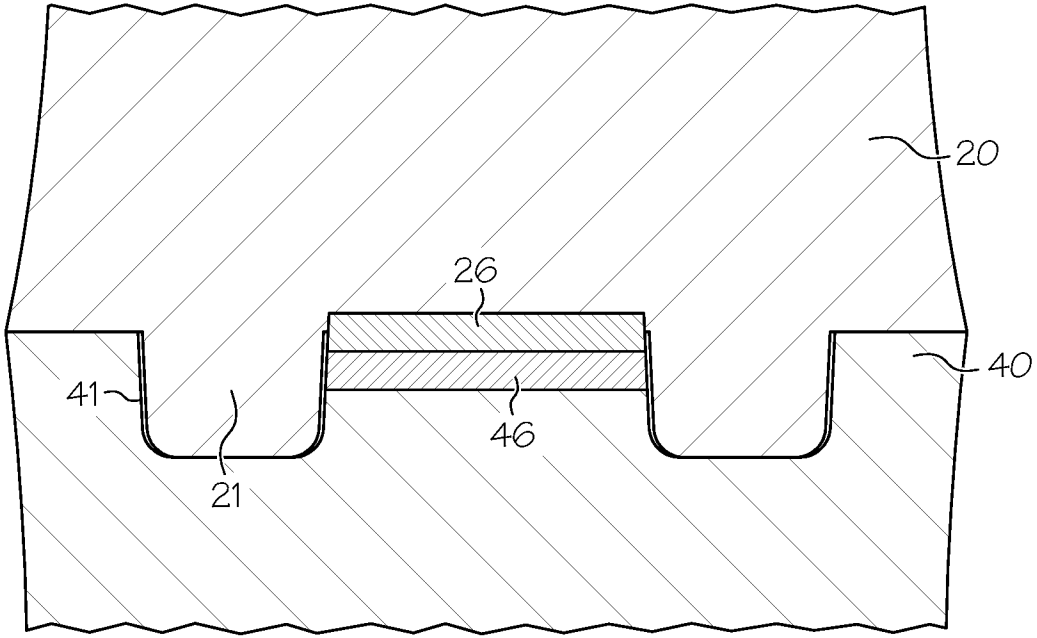
FIG. 7 is a partial cross section showing the perimeter ridge inserted within the perimeter channel, and the attachment material.

The perimeter ridge 21 of the bottom surface 20 is configured to align with and fit into the perimeter channel 41 of the top surface 40, as shown in the cut away cross sectional view of FIG. 7. Modern molding techniques allow for very precise molds so that the perimeter ridge 21 can be almost precisely sized and configured to fit within the perimeter channel 41. When molded properly the two components can snap together to create a relatively secure attachment. When the perimeter ridge 21 is inserted into the perimeter channel 41, the top attachment material 46 will engage the bottom attachment material 26 to secure the two components together. When the components are attached the paired perimeter ridge 21 and perimeter channel 41 will protect the attachment material 26 and 46 from dirt and other extraneous material that is encountered during wear. When dirt and other material gets into the hook and loop material is can reduce the ability of the securely hold. Such fouling of the attachment material 26 and 46 can reduce the ability of the material to hold the components together. The paired perimeter ridge 21 and perimeter channel 41 protects the attachment material 26 and 46 and ensures that it retains its attachment strength throughout the life of the convertible shoe 100.

In the preferred embodiment the perimeter ridge 21 and perimeter channel 41 run the entire length around the perimeter of the shoe component. In an alternate embodiment there can be a number of gaps in the perimeter ridge 21 and a number of corresponding blocks in the perimeter channel 41. The gaps are small spaces in the ridge 21, and the blocks are small filled sections in the channel 41. In some configurations, based on the size and style of the shoe, it is difficult to produce a fully workable shoe component with a fully contiguous ridge 21 and channel 41. Therefore, in order for these shoe models to function properly, the ridge 21 and channel 41 must have gaps or blocks to ensure that the material does not break.

There are a variety of pressures and forces on a shoe when the person wearing the shoe is walking. If the shoe is considered on the X-Y-Z axis, where the shoe runs from front to back on the X axis, top to bottom on the Y axis, and side to side on the Z axis, the forces occur in all three dimensions. The forces are also both static and dynamic, and constantly changing as the wearer walks in the shoe. There are obviously vertical, or up and down, forces created by the wearer stepping onto the shoe and exerting downward pressure, as well as upward pressure when the wearer steps forward and pulls up on the upper. This is known in the shoe making and design field as "peel forces" because these forces can cause the various layers of a shoe to peel apart. There are also dynamic forces as the wearer walks in the shoe. Many people step first onto their heel, which creates forward forces that slide the various layers of a shoe (any shoe) against each other. This is different for high heel shoes, where it is common for the person to step onto the ball of the foot. All people walk differently, and many twist their foot slightly while walking to create twisting forces. There are also lateral forces and the components of the shoe slide on each other. Many people also have a slight twisting motion from the ball of the foot to the toes as they step off of their trailing foot as they step forward. This causes torque forces on and near the front portion of the shoe. These various forces are known as shear forces. The combination of the shear and peel forces, and the fact that they are dynamic forces, makes it difficult to keep separate components of a shoe attached.

The paired attachment material 26 and 46 prevents the components from coming apart due to up and down or "peel" forces, and the placement of the perimeter ridge 21 within the perimeter channel 41 is designed to account for all of the other shear forces. Since the paired ridge 21 and channel 41 runs just inside the perimeter of the components, it can withstand lateral and twisting forces, and thus ensure the components of the shoe can stay together. The shoe components, as seen in FIGS. 3 & 4 and 8 & 9, are non-uniform in shape, and are similar in shape to most shoes, with the shoe widest near the toe where the ball of the wearers foot rests against the footbed 11, and narrowest towards the heel 13. This three dimensional non-uniform configuration allows the paired ridge 21 and channel 41 to account for all of the various three dimensional and non-vertical shear forces that are present on the shoe 100. The channel 41 and ridge 21 are a uniform distance from the outside perimeter surface 15, 35 or 55 of the insole 10, insert 30 and sole 50 respectively. This distance ranges from an eight of an inch (⅛") to half an inch (½") depending on the size of the shoe 100 and the configuration of the ridge 21 and channel 41. This prevents any overlap of material, but more allows the material on the outside of the channel 41 to withstand lateral and transverse shear forces on that component of the shoe 100. This is an improvement over Gross and the other cited prior art which include multiple alignment and attachment posts which do not account for the dynamic nature of the forces on a shoe.

Figure 8:
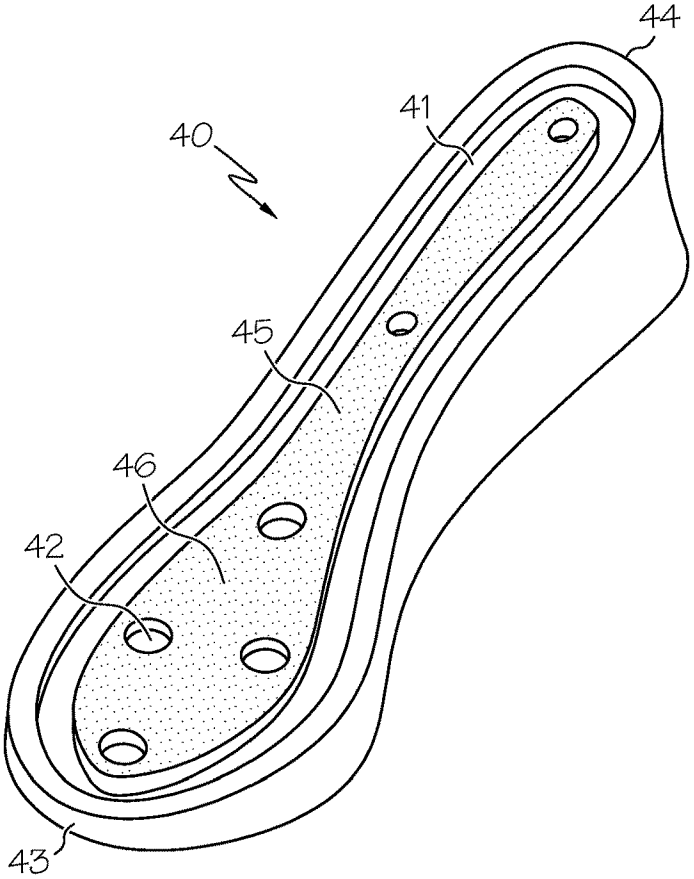
FIG. 8 is a top perspective view of the second embodiment of the top attachment showing the channel, the prong recesses, and the top attachment field.
Figure 10:
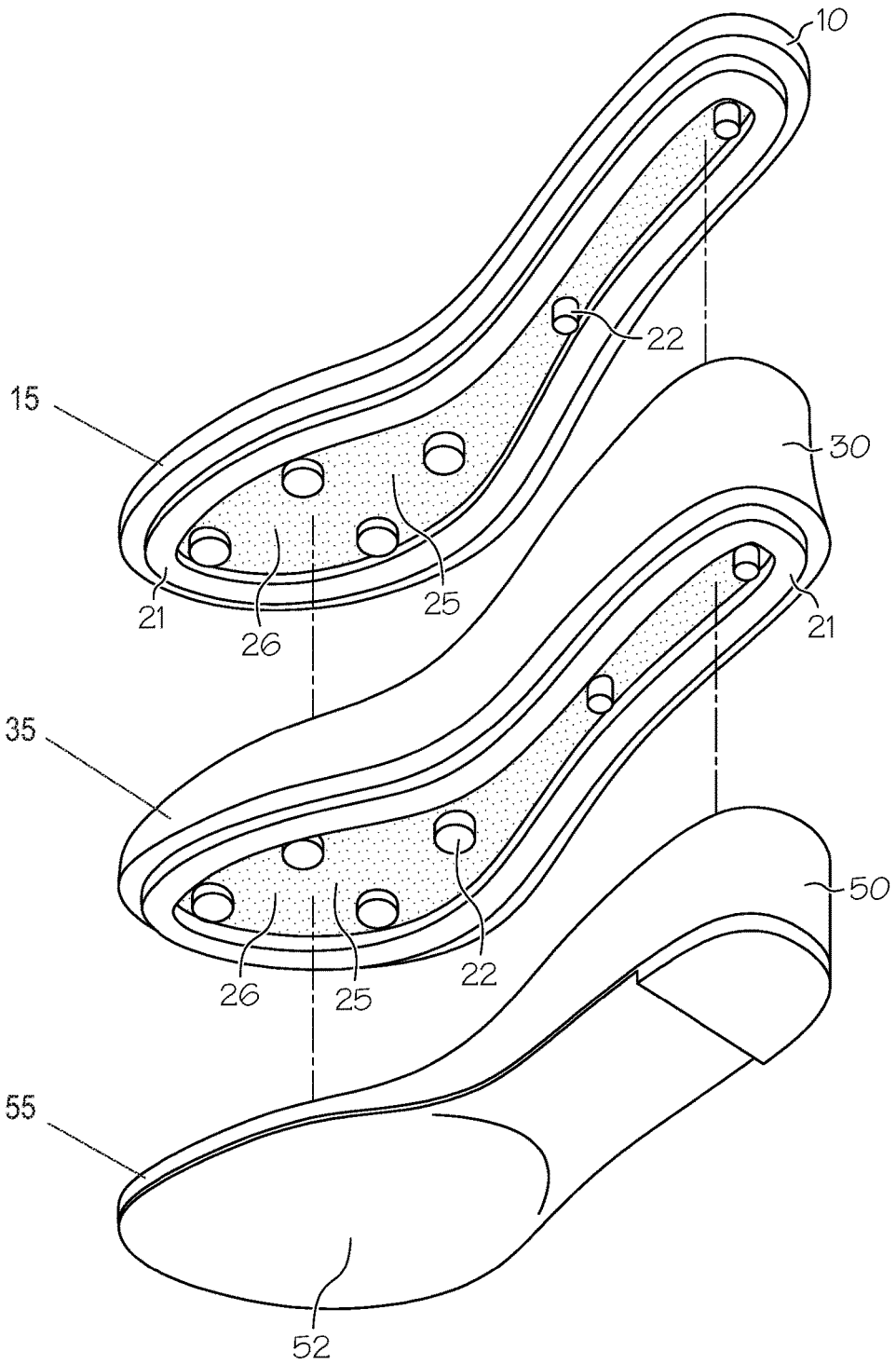
FIG. 10 is an exploded perspective from the underside of the convertible shoe showing the second embodiment of the bottom attachment of the insole and insert, and the tread of the sole.
Figure 11:
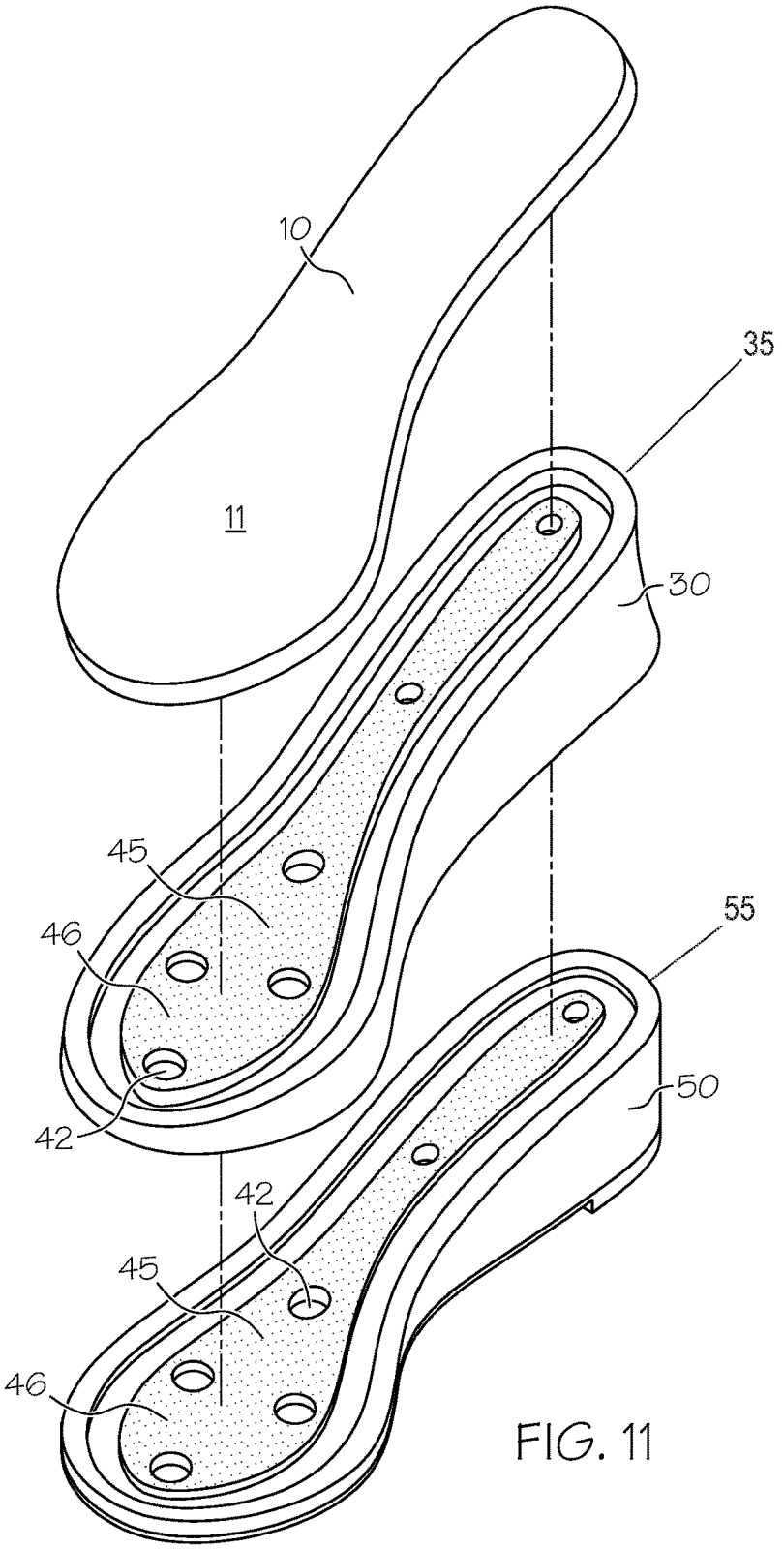
FIG. 11 is an exploded perspective from above the convertible show showing the footbed of the insole and the second embodiment of the top attachment of the insert and sole.

The second embodiment of the attachment means are show in FIGS. 8, 9, 10 & 11. The bottom surface attachment 20 is shown in FIG. 8. The bottom surface attachment 20 is the same in the bottom surface of the insole 10 and the insert 30. The bottom surface attachment 20 has a toe end 23 and a heel end 24, and consists of a perimeter ridge 21, a multiplicity of downwardly protruding prongs 22, and a bottom attachment field 25 which is located within the perimeter ridge 21. There is a sheet of attachment material 26 located in the bottom attachment field 25 and around the prongs 22. In one variation the attachment material 26 is standard hook and loop material common known as VELCRO®, and in another embodiment the attachment material 26 is Mushroom VELCRO® like brand named 3-M™ Dual Lock™ fastener. The bottom surface attachment 20 of the second embodiment is identical to the first embodiment but with the addition of the downwardly protruding prongs 22.

Figure 9:
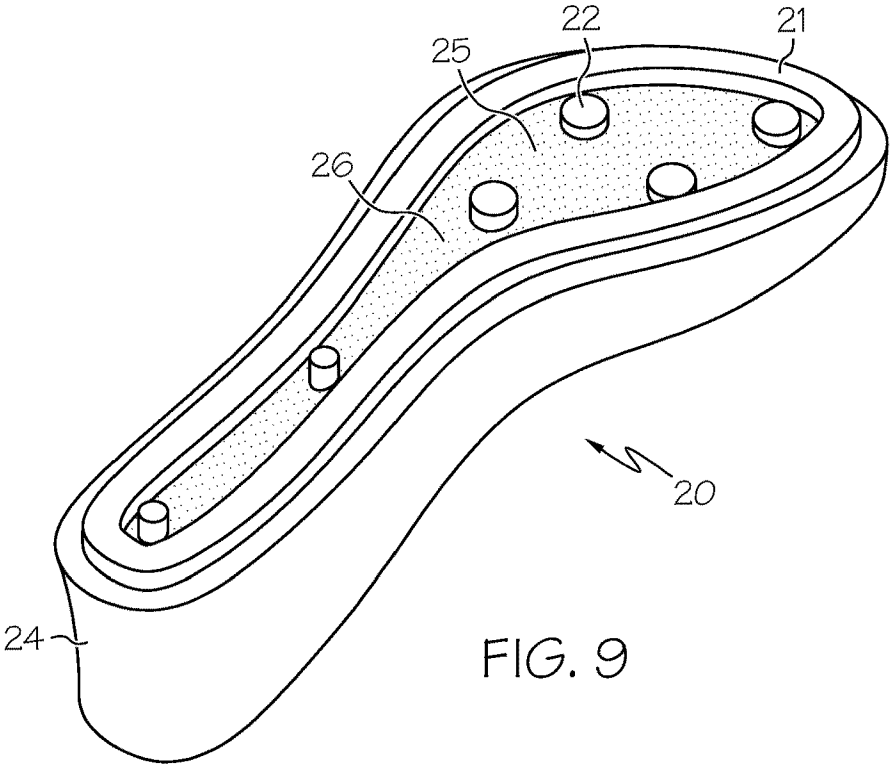
FIG. 9 is a bottom perspective view of the second embodiment of the bottom attachment, showing the protruding ridge, the protruding prongs, and the bottom attachment field.

The top surface attachment 40 of the second embodiment is shown in FIG. 9, and is the same in the top surface of the insert 30 and the sole 50. The top surface attachment 40 has a toe end 43 and a heel end 44, and consists of a perimeter channel 41, a multiplicity of alignment recesses 42, and a top attachment field 45 which is located on the top surface within the perimeter channel 41. The alignment recesses 42 are approximately 6.2 mm in diameter, but the actual diameter can vary slightly depending on the size and configuration of the shoe 100. In general there is one recess 42 located near the heel end, one recess located at the waist, or narrowest part of the shoe, one recess 42 located behind the ball of the foot area, two recesses 42 located approximately where the ball of the wearers foot will exert the most pressure, and one recess 42 located near the toe. The depth of the recess 42 corresponds to the height of the prongs 22 which vary according to location. The recess 42 at the waist is deepest, about 6 mm, while the recesses near the toe are shallowest, about 4 mm. The top surface attachment 40 of the second embodiment is identical to the first embodiment but with the addition of the alignment recesses 42. The perimeter channel 41 of the top surface 40 corresponds to the perimeter ridge 21 of the bottom surface 20 so that the perimeter ridge 21 protrudes downward and fits into the perimeter channel 41. The prongs 22 of the second embodiment of the bottom surface 20 are sized and aligned to fit within the alignment recesses 42 of the second embodiment of the top surface 40. There is a prong 22 near the toe, two prongs 22 located under the ball of the wearer's foot, one prong 22 located behind the ball of the foot area, one prong 22 located in the waist and one prong 22 located hear the heel. The prong 22 at the waist is the highest, of approximately 6 mm. This is to account for the need for extra sheer protection at that location. With modern molding techniques, the perimeter ridge 21 can be molded as an almost exact fit for the perimeter channel 41 such that the perimeter ridge 21 can snap into place inside the perimeter channel 41. When molded properly the two components can snap together to create a relatively secure attachment. There is a sheet of attachment material 46 located in the top attachment field 45. In one variation the attachment material 46 is standard hook and loop material common known as VELCRO®, and in another embodiment the attachment material 46 is Mushroom VELCRO®. Obviously the top attachment material 46 will correspond to the bottom attachment material 26, so both will either be standard hook and loop material or both will be mushroom VELCRO®.

Figure 17:
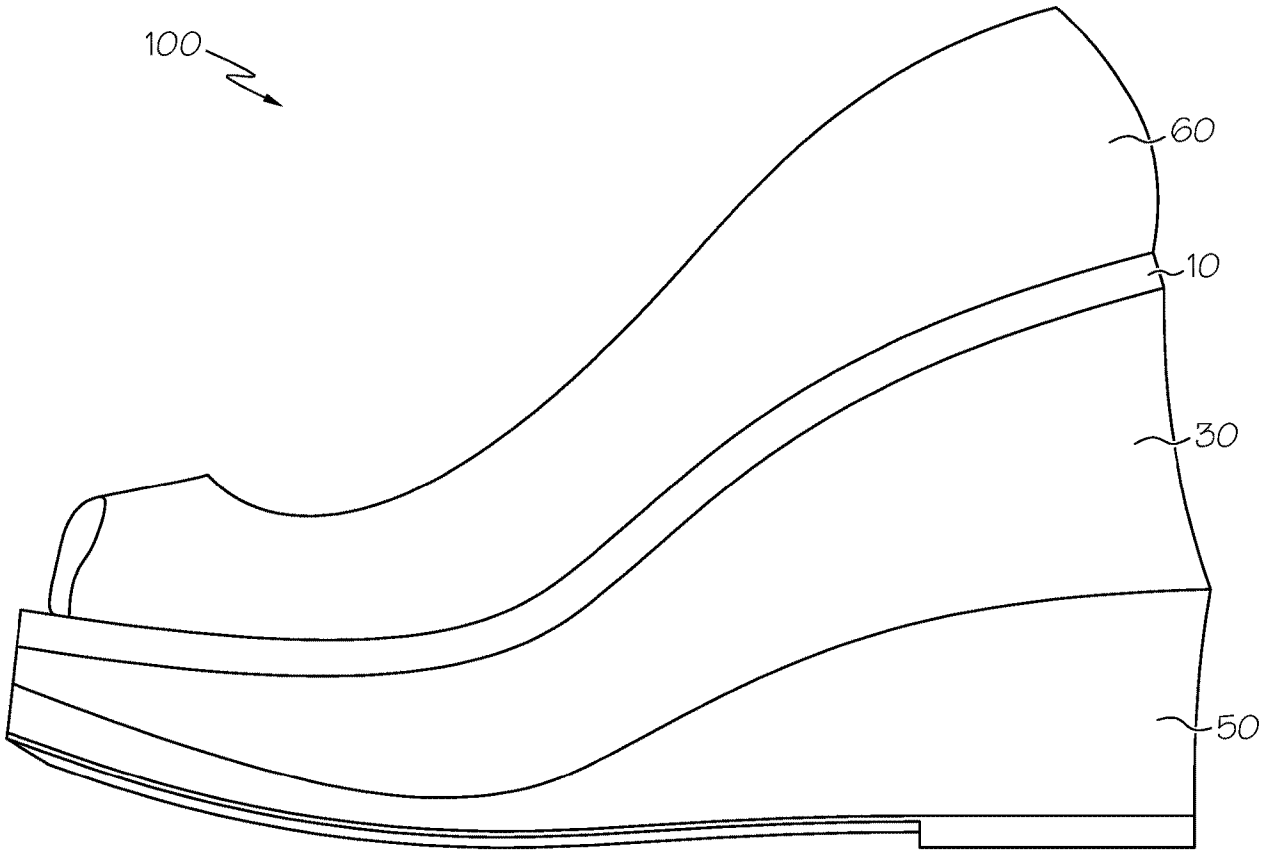
FIG. 17 is a side view of a different embodiment of the upper of the convertible shoe.
Figure 18:
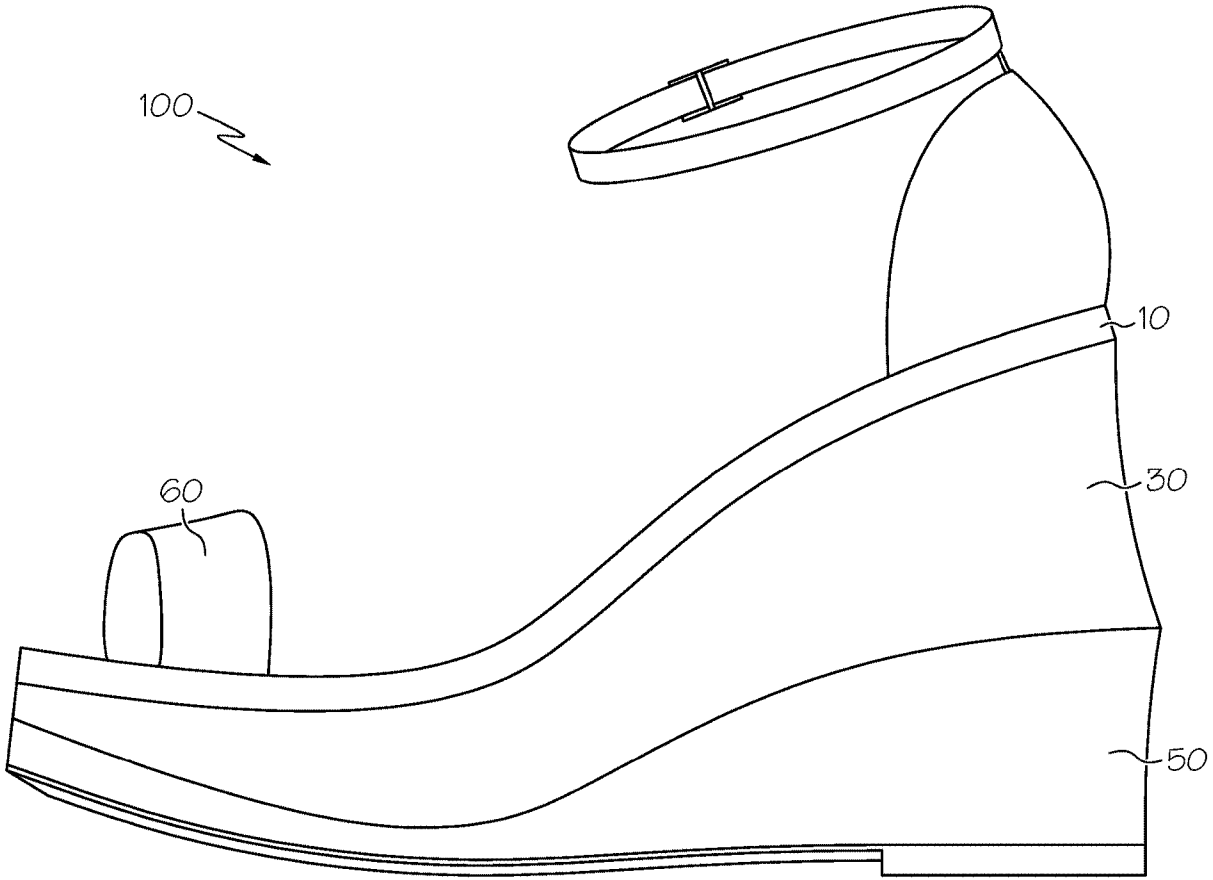
FIG. 18 is a side view of a different embodiment of the upper of the convertible shoe.

In the preferred embodiment the components, the insole 10, the insert 30 and the sole 50, are made of injection molded plastic in a process well known in the art. The components can be made from a variety of molded plastic materials, including, but not limited to ethylene vinyl acetate (EVA) plastic, polyethylene (PE) plastics, polyurethane (PU) plastic, or any other molded plastic materials well known in the art. The upper insole 10 will have a shoe upper 60 to hold the foot against the footbed 11. The shoe upper 60 can be any number of common styles and variations, ranging from a simple toe strap to more elaborate enclosed shoe uppers. A couple of different variations are seen in FIGS. 17 & 18, but it is possible, and within the conception of the invention, for the upper 60 to be in any style of woman's shoes. There is also a man's version with changeable sole 50 and tread 52, so the upper 60 can come in a wide variety of men's styles. The shoe upper 60 can be made of any common material for making shoe uppers including cloth and leather, as well as a variety of other natural or synthetic materials. The upper 60 is attached to the insole 10 by well known and conventional means, including but not limited to sewing and gluing. The visible outsides perimeters of the upper insole 10, middle insert 30, and bottom sole 50 can be covered with a veneer or other decorative material to create a decorative and stylish shoe. For example, one common veneer for wedge shoes is cork. The underside of the bottom sole 50, or tread 52, can be any type of conventional shoe bottom sole material from synthetics and plastics to leather.

Figure 12:
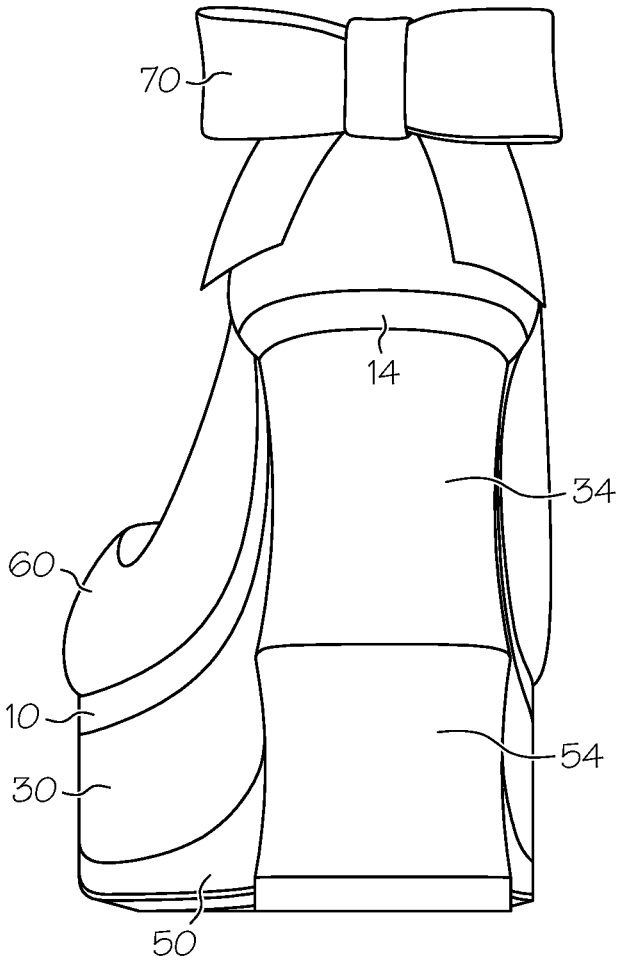
FIG. 12 is a rear view of the convertible shoe showing the concave cross section of the heel of the sole and insert, and the flared cross section of the heel of the insole.

Referring now to FIG. 12, a rear view of the convertible shoe 100, the insole heel end 14 of the insole 10 has a slightly flared cross section, with the edge near the footbed 11 wider than the edge near the bottom surface 12. The flared cross section creates a gripping surface to allow the user to grip the heel end 14 of the insole 10 in one hand. The insert heel end 34 of the insert 30 has a concave cross section to create a convenient gripping area. The sole heel end 54 also has a concave cross section to create a convenient gripping area. This allows the user to grasp the flared insole heel end 14 in one hand and the concave sole heel end 54 in the other hand and pull the components apart.

The attachment means described above are designed to hold the components (the insole 10, insert 30, and sole 50) securely together to deal with the dynamic forces of walking. In the current design the combination of the paired attachment material 26 & 46, and the paired perimeter ridge 21 and perimeter channel 41, has proven to have sufficient holding strength to hold the components together during walking. Unfortunately the strength of the bond created makes it difficult to separate the components. The flared insole heel end 14 was designed to provide a handgrip at the heel end 14, and the concave insert heel end 34 and concave sole end 54 were designed to create a handgrip to allow the wearer to hold the shoe to separate the components. The flared end and concave ends are not only functional but also ad an additional hour-glass shaded cross section style element to the convertible shoe 100. When all three components are together the user can grasp the flared insole heel end 14 in one hand and the concave cross section of the sole heel end 54 in the other hand and pull the components apart. In this position the sole 50 might come off the insert 30 or the insert 30 might separate from the insole 10. Once these two components are separated, the user can repeat the process with the remaining two components.

Figure 6:
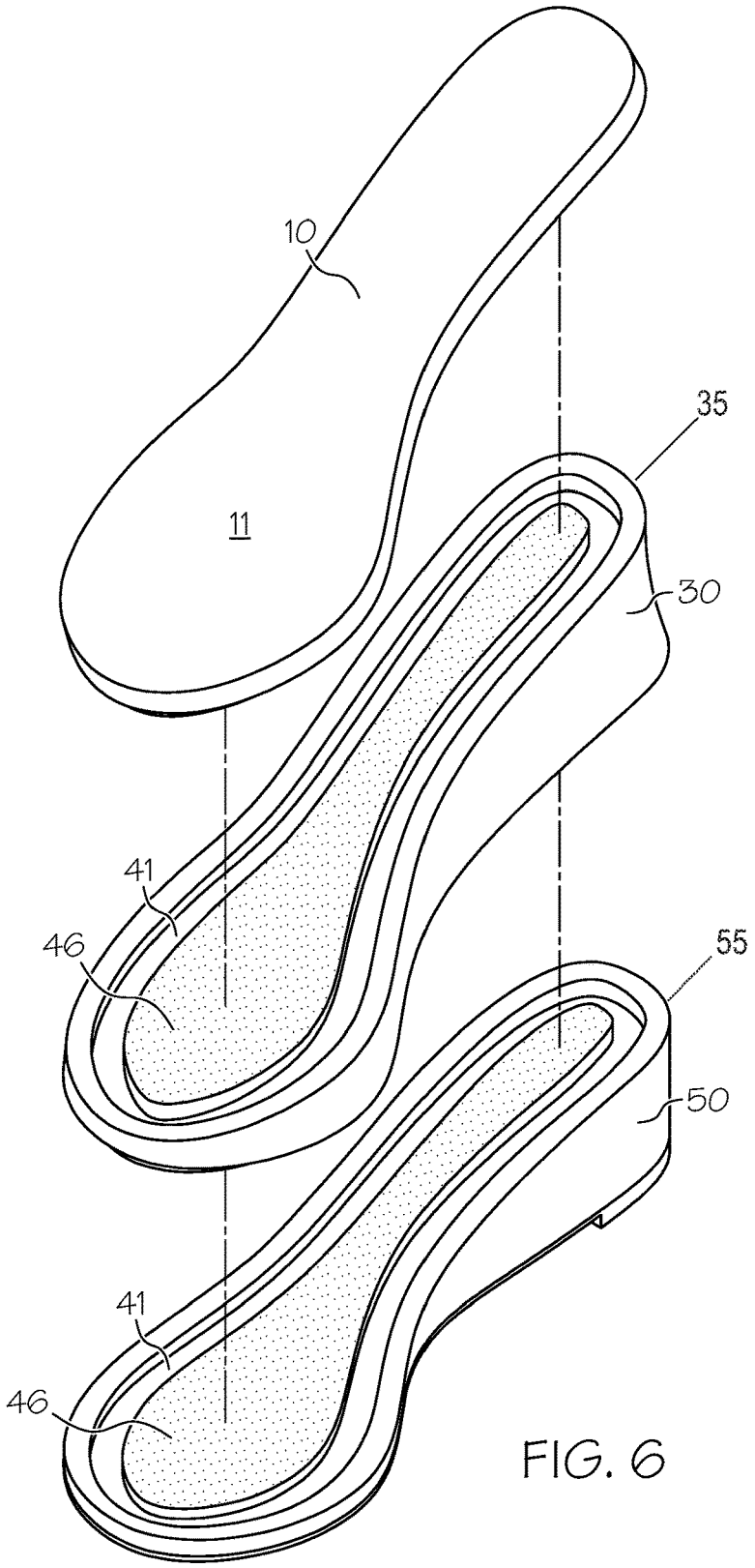
FIG. 6 is an exploded perspective from above the convertible shoe showing the footbed of the insole and the first embodiment of the top attachment of the insert and sole.
Figure 13:
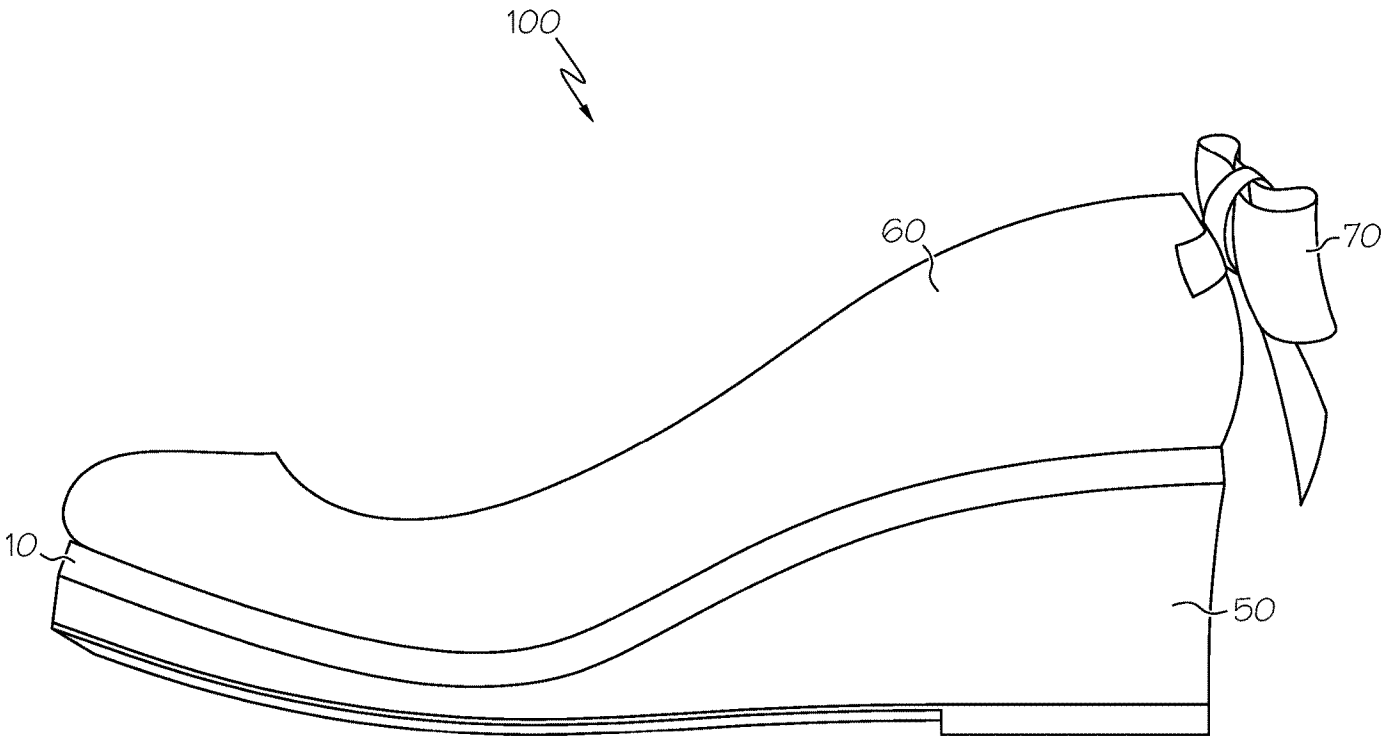
FIG. 13 is a side view of the convertible shoe showing the insole attached directly to the sole for the low heel version of the shoe.
Figure 14:
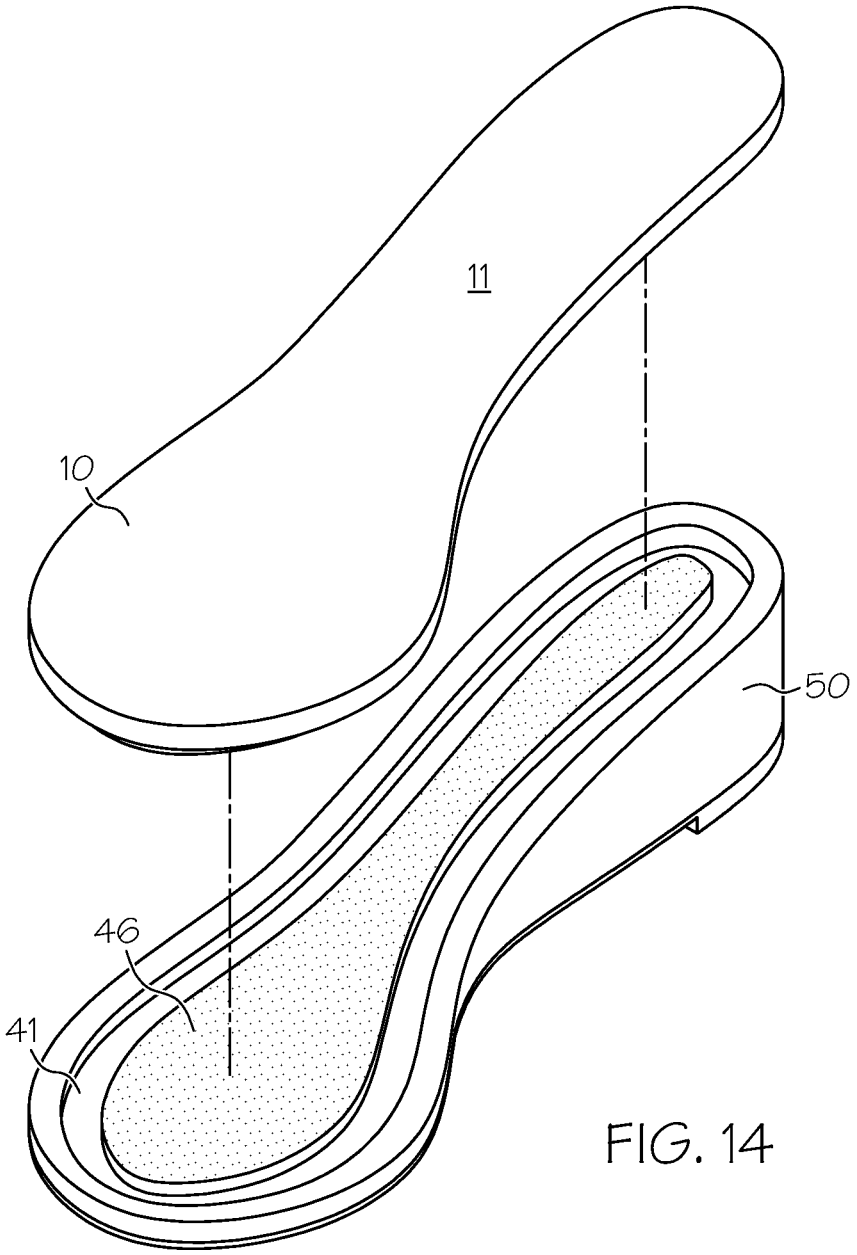
FIG. 14 is an exploded side view of the convertible shoe showing the insole in position to be attached directly to the sole.

The main purpose of the convertible shoe 100 is to be able to change from a high heel to a lower heel for comfort. FIGS. 13 & 14 show the convertible shoe 100 in the low heel version, without the addition of the insert 30. In this version the insole 10 is attached directly to the sole 50. FIG. 1 depicts the convertible shoe 100 in the high heel version, and FIG. 13 depicts the same shoe in the low heel version. These figures show the sole 50 with a heel 54 that is slightly thicker than the toe 53. It is possible, and within the conception of the invention, for the heel 54 and toe 53 of the sole 50 to be of nearly the same thickness to create a flat style shoe. Because of the geometry of the perimeter channel 41, the sole must be at least one inch thick to accommodate the channel 41 and still retain sufficient strength. FIG. 14 shows a perspective of the insole 10 in place to be attached to the sole 50 for the low version of the shoe. FIG. 14 shows the first embodiment, without prongs 22 and recesses 42, but it is also possible to use the second embodiment with prongs 22 and recesses 42 for the low version of the shoe 100. FIG. 6 shows the shoe 100 with the insert 30, to created the high heel version of the shoe 100, and FIG. 14 shows the same shoe 100 without the insert 30 to create the low heel version of the shoe 100.

Figure 15:
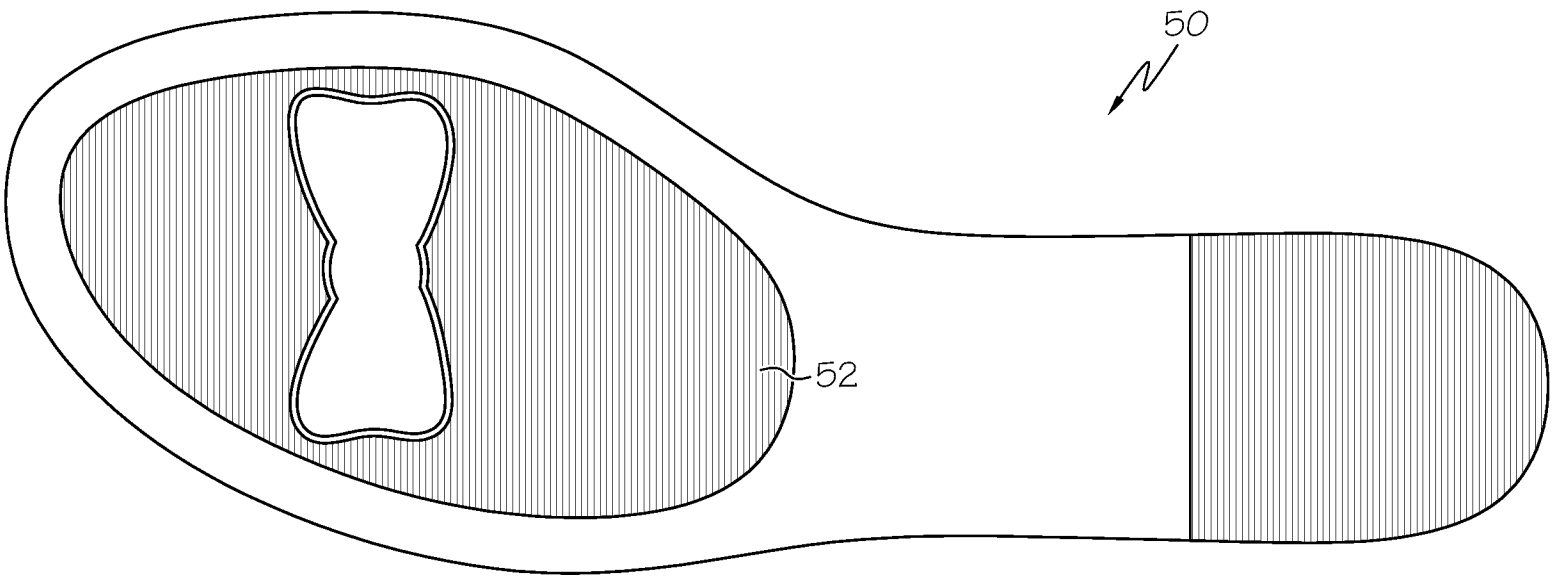
FIG. 15 is a bottom view of the tread on the bottom of the sole of the convertible shoe.
Figure 16:
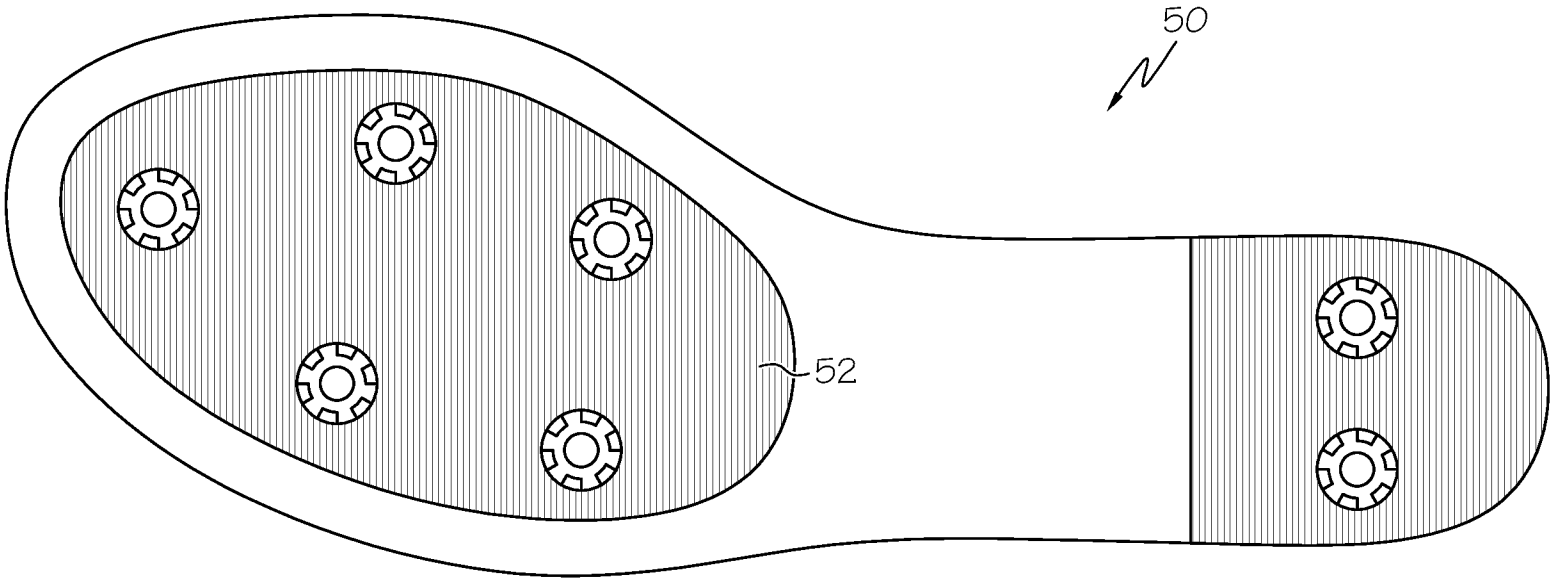
FIG. 16 is a bottom view of a golf shoe version of the tread.

It is possible, and within the conception of the invention to use a variety of different treads 52 on the soles 50. In one configuration, shown in FIG. 16, the tread 52 will include golf spikes. In this embodiment the user will have two bottom soles 50 with one insole 10 with an upper 60. One bottom sole 50 will have a standard shoe sole tread, such as seen in FIG. 15, and the other bottom sole 50 will have a golf shoe sole with spikes, as seen in FIG. 16. In this variation of the shoe 100 the sole 50, as described above, will have a relatively uniform thickness, which is generally necessary for sport shoes, and is generally common for men's shoes. This will allow the user to wear the same pair of shoes for golf and for non-golf wear. Other combinations include a dressier leather of faux leather tread 52 and a sport or tennis shoe style tread 52, which will allow the wearer to convert from a dress shoe to a casual shoe.

Figure 19:
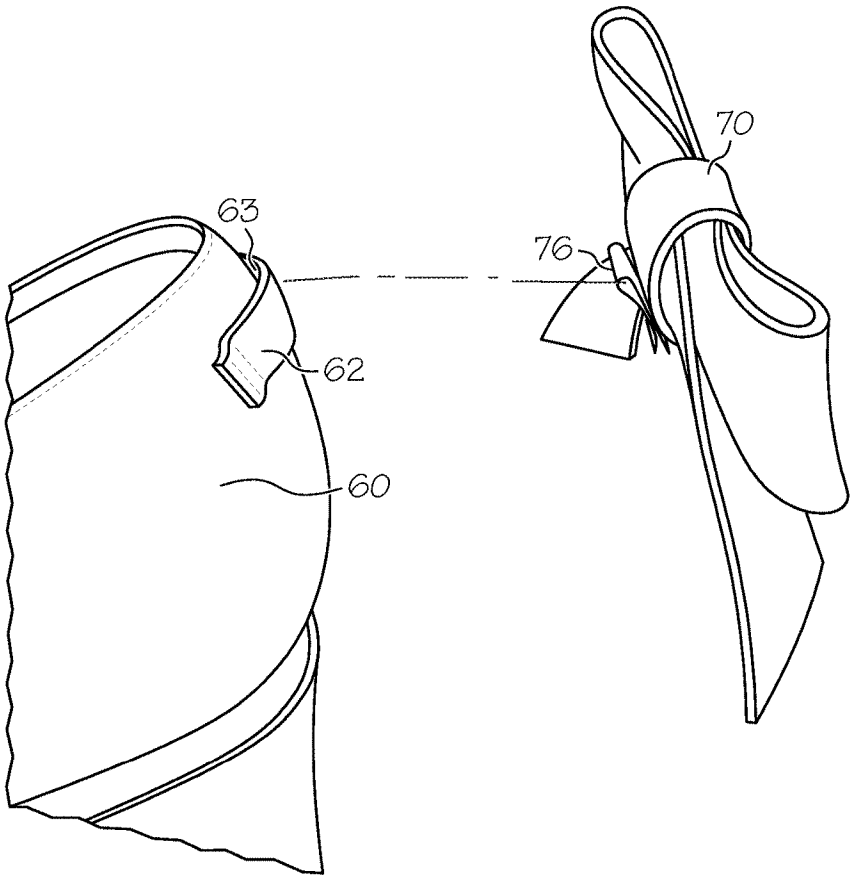
FIG. 19 is a detail of the bow and clip on the heel of the insole and sole of the convertible shoe.

FIG. 19 shows a removable bow 70. The bow 70 is attached to the upper 60 by means of a clip 76 attached to the bow 70, which slides into a tab 62 that is attached to the upper 60. In the preferred embodiment, the tab 62 is attached to the upper on two ends, leaving a slip space 63 in the middle to allow bow clip 76 to slide in to attach the bow 70 to the upper 60. In one variation the bow clip 76 includes a spring to allow easy opening of the clip, and teeth on the clip 76 to ensure that the bow 70 cannot slip off the tab 62. It is possible to use any decorative feature, or heel jewelry, in place of the bow 70 and use the tab 62 to attach the decorative feature. The heel jewelry can come in a wide variety of configurations from flowers to metallic letters to allow personalization of the shoe. The embodiment depicted in FIG. 19 shows the tab 62 attached to the upper, but it is possible, and within the conception of the invention, to attach a tab 62 to the sole 50 or the insert 30. This allows the owner of the shoe 100 to fully personalize the shoe 100 with a variety of decorative features.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. A convertible shoe comprising:

a top portion having a foot bed and an upper, a top portion outside perimeter, a top portion toe end, a top portion heel end, a top portion bottom surface and a top portion underside attachment disposed on said top portion bottom surface;

a middle insert having a middle insert outside perimeter, a middle insert toe end, a middle insert heel end wherein said middle insert heel end is thicker than said middle insert toe end, a middle insert top surface with a middle insert topside attachment disposed on said middle insert top surface, and a middle insert bottom surface with a middle insert underside attachment disposed on said middle insert bottom surface; a bottom portion having a bottom portion outside perimeter, a bottom portion toe end, a bottom portion heel end, a bottom portion top surface with a bottom portion topside attachment disposed on said bottom portion top surface, and a bottom portion bottom surface having a tread;

wherein said top portion underside attachment can mate with either the middle insert topside attachment or the bottom portion topside attachment, and wherein said bottom portion topside attachment can mate with said top portion underside attachment or said middle insert underside attachment;

and wherein further said top portion outside perimeter has a heel end having an external flared cross section profile between the foot bed and the top portion bottom surface to provide a gripping area, said middle insert outside perimeter has a heel end with a perimeter of the middle insert top surface and a perimeter of the middle insert bottom surface each having an external flared cross section creating a middle insert heel end height that extends between the perimeter of the middle insert top surface and the perimeter of the middle insert bottom surface, the middle insert heel end height having an external concave cross section profile to provide a gripping area, and said bottom portion outside perimeter has a heel end with a perimeter of the bottom portion top surface and a perimeter of the bottom portion bottom surface having an external flared cross section creating a bottom portion heel end height that extends between the perimeter of the bottom portion top surface and the perimeter of the bottom portion bottom surface, the bottom portion heel end height having an external concave cross section profile to provide a gripping area.

2. The convertible shoe of claim 1 wherein when said top portion underside attachment is mated with said bottom portion topside attachment the top portion is attached directly to said bottom portion to create a low heeled shoe.

3. The convertible shoe of claim 1 wherein when said top portion underside attachment is mated with said middle insert topside attachment to attach said middle insert to said top portion, and said middle insert underside attachment is mated with said bottom portion topside attachment so that said middle insert is attached between said top portion and said bottom portion to create a high heeled shoe.

4. The convertible shoe of claim 1 wherein when said top portion underside attachment is mated with said bottom portion topside attachment the top portion is attached directly to said bottom portion to create a low heeled shoe; and when said top portion underside attachment is mated with said middle insert topside attachment to attach said middle insert to said top portion and said middle insert underside attachment is mated with said bottom portion topside attachment said middle insert is attached between said top portion and said bottom portion to create a high heeled shoe.

5. The convertible shoe of claim 1 wherein top portion underside attachment is identical to said middle insert underside attachment to create a uniform underside attachment having a uniform underside outside perimeter, and wherein said middle insert topside attachment is identical to said bottom portion underside attachment to create a uniform topside attachment having a uniform topside outside perimeter such that said top portion can be attached directly to said bottom portion to create a low heeled shoe, or said top portion can be attached to said middle insert which can be attached to said bottom portion to create a high heeled shoe.

6. The convertible shoe of claim 5 wherein:

said uniform underside attachment further comprising;

a protruding ridge that is offset a uniform distance from said uniform underside outside perimeter, said protruding ridge protruding perpendicularly from said uniform underside attachment, said protruding ridge defining and surrounding an underside attachment field with an underside attachment material disposed thereon;

said uniform topside attachment further comprising;

a recessed channel that is offset a uniform distance from said uniform topside outside perimeter, said recessed channel recessed perpendicularly into said uniform underside attachment, said recessed channel defining and surrounding a topside attachment field with a topside attachment material disposed thereon;

wherein said protruding ridge is configured to be inserted perpendicularly into said recessed channel such that said protruding ridge mates with said recessed channel to create a secure yet removable attachment between said uniform underside attachment and said uniform topside attachment;

wherein further said underside attachment material mates with said topside attachment material to further secure said uniform underside attachment to said uniform topside attachment.

7. The convertible shoe of claim 6 wherein said topside attachment material and said underside attachment material is hook and loop material.

8. The convertible shoe of claim 6 wherein said topside attachment material and said underside attachment material is head and stem attachment material.

9. The convertible shoe of claim 6 wherein said protruding ridge has a substantially rectangular cross section, and wherein said recessed channel has a substantially rectangular cross section such that said protruding ridge mates with said recessed channel.

10. The convertible shoe of claim 6 wherein said upper can be configured in a closed toe, an open toe, or a toe strap shoe style.

11. The convertible shoe of claim 6 further comprising a multiplicity of bottom portions having different treads wherein said top portion can be attached to one of said multiplicity of bottom portions to provide a shoe for different uses.

12. The convertible shoe of claim 1, wherein: said bottom portion heel end is between one and twelve times greater in height than said bottom portion toe end to create a wedged shaped bottom portion; said middle insert heel end is between four and twelve times greater in height than said middle insert toe end to create a wedge shaped insert portion.

* * * * *